US010501946B2

(12) United States Patent
Bordin

(10) Patent No.: US 10,501,946 B2
(45) Date of Patent: Dec. 10, 2019

(54) PROFILED ELEMENT FOR TERRACES AND BALCONIES

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 16/054,712

(22) Filed: Aug. 3, 2018

(65) Prior Publication Data

US 2019/0063083 A1 Feb. 28, 2019

(30) Foreign Application Priority Data

Aug. 22, 2017 (IT) ..... 102017000094883

(51) Int. Cl.

| | |
|---|---|
| ***E04F 19/06*** | (2006.01) |
| ***E04F 15/02*** | (2006.01) |
| ***E04D 13/04*** | (2006.01) |
| ***E04D 13/15*** | (2006.01) |

(52) U.S. Cl.

CPC ..... *E04F 19/061* (2013.01); *E04D 13/0459* (2013.01); *E04F 15/02183* (2013.01); *E04D 13/15* (2013.01); *E04D 2013/0468* (2013.01)

(58) Field of Classification Search

CPC ..... E04F 19/061; E04F 15/02183; E04F 2013/0468; E04D 13/0459; E04D 13/15; E04D 13/158

See application file for complete search history.

(56) References Cited

U.S. PATENT DOCUMENTS

| | | | | |
|---|---|---|---|---|
| 3,365,847 | A * | 1/1968 | Josek | E04D 13/15 52/58 |
| 4,037,372 | A * | 7/1977 | Patry | E04D 13/155 248/214 |
| 4,780,997 | A * | 11/1988 | Taylor | E04D 13/15 52/96 |
| 4,970,832 | A * | 11/1990 | van Herpen | E04D 13/15 52/60 |
| 5,579,611 | A * | 12/1996 | Buckenmaier | E04D 13/0459 52/11 |
| 6,606,827 | B1 * | 8/2003 | Hoffmann | G09F 13/22 362/146 |

(Continued)

FOREIGN PATENT DOCUMENTS

| | | |
|---|---|---|
| DE | 202004003286 U1 | 5/2004 |
| DE | 102013102587 A1 | 9/2014 |

(Continued)

*Primary Examiner* — Brian D Mattei

(74) *Attorney, Agent, or Firm* — Cantor Colburn LLP

(57) ABSTRACT

A profiled element for terraces and balconies includes a substantially flat wing for anchoring the profiled element to the floor, a front portion for protecting an outer edge of a floor paving and protruding outward with respect thereto, and a drip lip which is constituted by a contoured element that extends downward from the wing, in a region to be arranged at an edge of a terrace. The drip lip includes at a lower end, at least one first protrusion and at least one second protrusion, the second protrusion being disposed lower than the first protrusion, and both protruding outward with respect to the front portion.

9 Claims, 3 Drawing Sheets

(56) References Cited

U.S. PATENT DOCUMENTS

| | | | | |
|---|---|---|---|---|
| 9,284,734 | B1 * | 3/2016 | Inzeo | E04D 13/0459 |
| 2003/0056445 | A1 * | 3/2003 | Cox | E04B 5/10 52/62 |
| 2005/0005551 | A1 * | 1/2005 | Graham | E04D 13/0459 52/415 |
| 2013/0055651 | A1 * | 3/2013 | Garcia | E04D 13/15 52/58 |
| 2015/0184394 | A1 * | 7/2015 | Nark | E04D 13/103 219/213 |
| 2017/0226741 | A1 * | 8/2017 | Givens | E04D 13/15 |
| 2018/0038117 | A1 * | 2/2018 | Bordin | E04F 15/02452 |
| 2018/0334813 | A1 * | 11/2018 | Schluter | E04F 19/061 |

FOREIGN PATENT DOCUMENTS

| | | | |
|---|---|---|---|
| EP | 0828037 | A2 | 3/1998 |
| EP | 2025827 | A1 | 2/2009 |

* cited by examiner

PROFILED ELEMENT FOR TERRACES AND BALCONIES

CROSS REFERENCE TO RELATED APPLICATIONS

This application is related to and claims the benefit of Italian Patent Application No. 102017000094883, filed on Aug. 22, 2017, the contents of which are herein incorporated by reference in their entirety.

TECHNICAL FIELD

The present disclosure relates to a profiled element for terraces and balconies.

BACKGROUND

The use is widespread of profiled elements for laying along the external perimeter of terraces and of balconies, to protect the edges of the tiles and to ensure correct drainage of water downward.

Profiled elements are known which are provided with a perforated wing for anchoring to the balcony, over which the tiles are laid, which ensures the fixing of the profiled element to the support and which has drainage slots for the outflow of any water that seeps under the tiles. They also have a front portion in front of the outer edge of the floor paving, with the interposition of sealant, and they are characterized by the presence of a drip lip element, which is constituted by a drip edge projection that protrudes outward at the lowest point of the profiled element, with the purpose of slowing the water and redirecting it outward, in order to make the water drip away from the walls, while favoring its vertical descent.

FIG. 1 shows an example of such conventional profiled elements.

In the example, the profiled element is generally designated by the reference letter A, the wing with the letter B, a slotted drainage hole with C, the front portion with D and the drip edge projection with E.

As will be made clear below, these show room for improvement.

First of all, especially for abundant quantities of water, the drip edge projection is often, not sufficient to ensure a vertical descent of the water, which instead tends to veer toward the vertical wall below the terrace.

Often during the laying of profiled elements the operators cannot maintain an optimal distance from the edge of the tiles, which would assist in preventing the falling water from veering toward the wall.

Sealant is inserted between the front portion and the outer edge of the tiles, and the grip of this sealant to the front portion is not always guaranteed.

Furthermore, the sealant obstructs the drainage slots, thus limiting the drainage capacity of the system.

Another drawback lies in the fact that affixing connector elements between two profiled elements is not easy for the operators, who have to carry out this operation after laying the profiled elements.

SUMMARY

The aim of the present disclosure is to provide a profiled element for terraces and balconies which is capable of improving the known art in one or more of the above mentioned aspects.

Within this aim, the disclosure provides a profiled element for terraces, in order to prevent the return of the water toward the wall and favor a better outflow of water that has seeped under the tiles.

The disclosure also provides a profiled element that ensures an optimal hold on the floor paving and on the edge of the tiles.

The disclosure further provides a profiled element that facilitates the affixing of the connectors.

The present disclosure also overcomes the drawbacks of the known art in an alternative manner to any existing solutions.

The disclosure further provides a profiled element that is highly reliable, easy to implement and low cost.

This aim and these and other advantages which will become better apparent hereinafter are achieved by providing a profiled element for terraces and balconies comprising a substantially flat wing for anchoring the profiled element to the floor, a front portion for protecting an outer edge of a floor paving and protruding outward with respect thereto, a drip lip which is constituted by a contoured element that extends downward from said wing, in a region to be arranged at an edge of a terrace, wherein said drip lip comprises, at a lower end, at least one first protrusion and at least one second protrusion, lower than the first protrusion, both protruding outward with respect to said front portion, optionally provided with one or more of the characteristics of the dependent claims.

BRIEF DESCRIPTION OF THE DRAWINGS

Further characteristics and advantages of the disclosure will become better apparent from the detailed description that follows of a preferred, but not exclusive, embodiment of the profiled element according to the disclosure, which is illustrated for the purposes of non-limiting example in the accompanying drawings wherein.

DETAILED DESCRIPTION OF THE DRAWINGS

Figure 1:
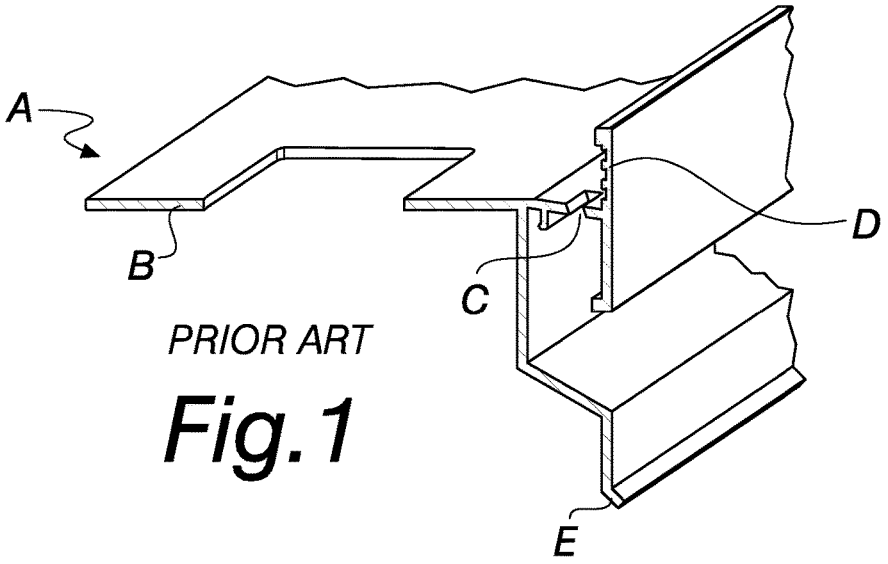
PRIOR ART Fig.1
FIG. 1 shows an example of conventional profiled elements.

With reference to the figures, the profiled element according to the disclosure, generally designated by the reference numeral 10, comprises:

- a substantially flat wing 11 for anchoring the profiled element to the floor,
- a front portion 12 for protecting the outer edge 13 of the floor paving and protruding outward with respect thereto,
- a drip lip 14 constituted by a contoured element that extends downward from the wing 11, in the region to be arranged at the edge of the terrace 21.

Figure 3:
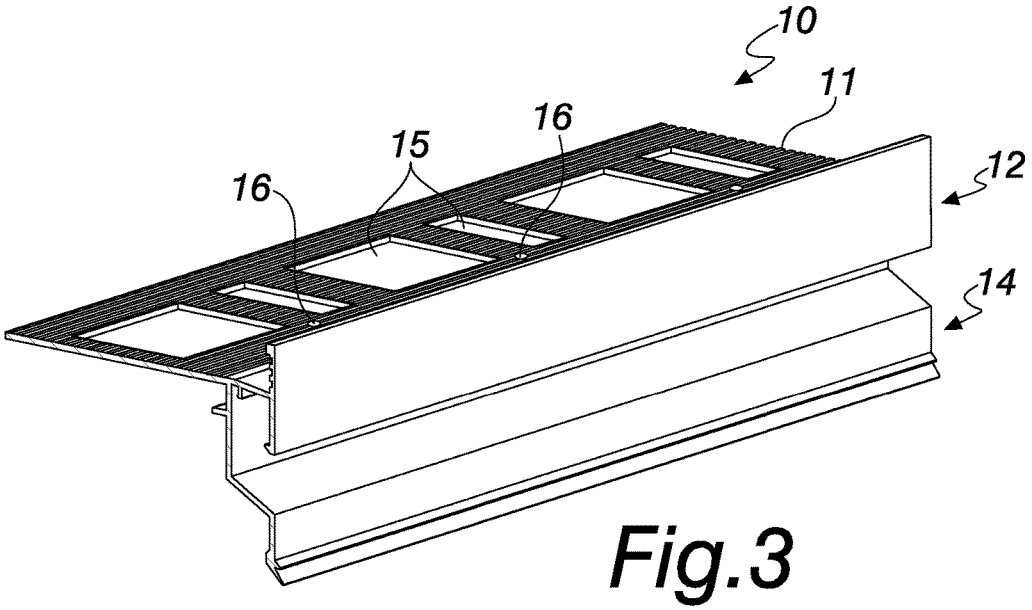
FIG. 3 is a perspective view of the profiled element according to the disclosure.

The wing 11, as can be seen in the perspective view in FIG. 3, is provided with openings 15 and holes 16 of diameter comprised preferably between 2 mm and 10 mm, which make it possible to mechanically affix the profiled element by way of nails and/or screws before laying the floor.

The wing 11 is provided with dovetail longitudinal incisions 17 in order to facilitate the anchoring of adhesive and a connecting strip, which are conventional.

The drip lip 14 comprises, at the lower end, at least one first protrusion 18 and at least one second protrusion 19, lower than the first, both protruding outward with respect to the front portion 12.

Advantageously, the second protrusion 19 protrudes further outward than the first protrusion 18.

The second protrusion 19 has an inclination with respect to a horizontal plane which is comprised between 20° and 65°.

Figure 2:
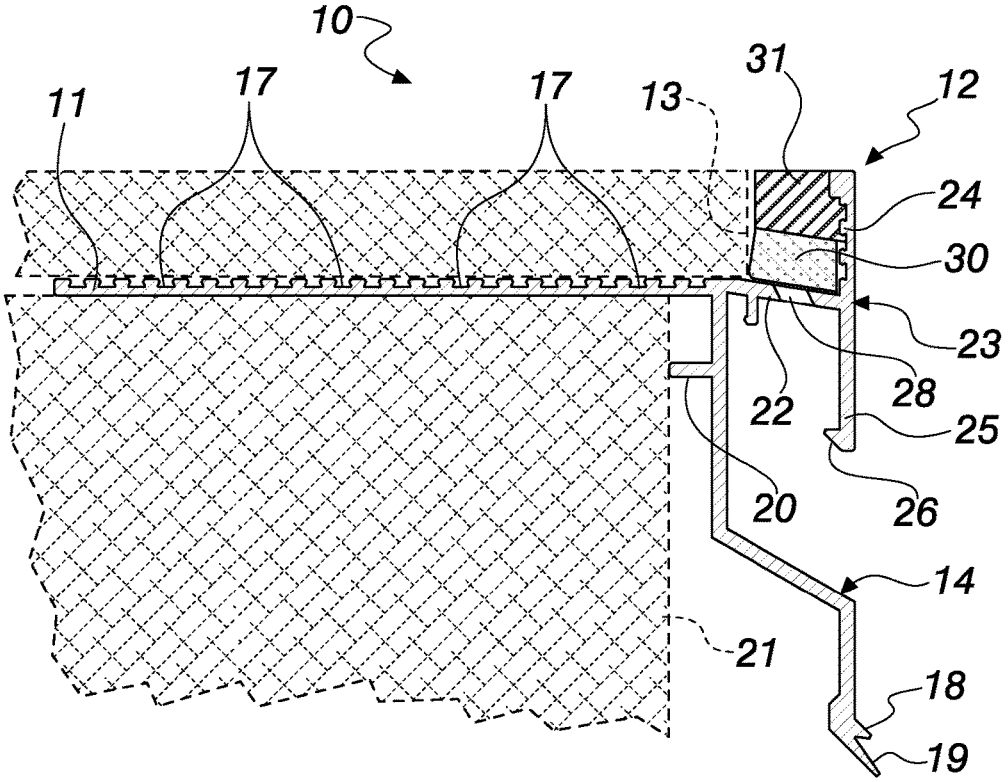
FIG. 2 is a cross-sectional side view of the profiled element according to the disclosure.

According to a first variation, the first protrusion 18 and the second protrusion 19 include two cusps, as shown in FIG. 2.

Figure 4:
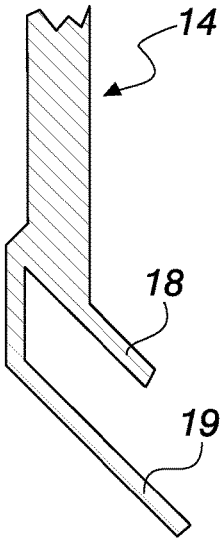
FIG. 4 is a cross-sectional view of an enlarged detail of a variation of the profiled element according to the disclosure.

In a second variation, they include two tabs, as shown in the enlargement in FIG. 4.

The profiled element 10 also comprises a spacer 20 for spacing the front portion 12 from the edge of the terrace 21, which includes a tab that protrudes from the rear of the drip lip 14 and is designed to rest with its free end on the edge of the terrace 21.

The spacer element 20 prevents the front part of the profiled element from coming into contact with the water drained from the surface of the terrace.

The tab that defines the spacer element 20 must have a length preferably comprised between 5 mm and 20 mm.

The front portion 12 has a cross-section that is substantially shaped like a letter T rotated by 90°, comprising a central connection 22 to the wing 11 and a screen 23, substantially on a vertical plane of arrangement, with an upper portion 24 and a lower portion 25. Dovetail incisions are defined on the inner side of the upper portion 24, to improve the grip with a sealant for coverings.

The central connection 22 is inclined downward and is provided with water drainage openings 28. Such openings preferably have a length comprised between 2 mm and 40 mm, a width comprised between 1 mm and 10 mm and a distance between centers comprised between 5 cm and 20 cm. The lower portion 25 has, at the lower end, a tooth 26 which is directed inward for anchoring a connector 27 for connecting the profiled element 10 to a similar profiled element.

Figure 5:
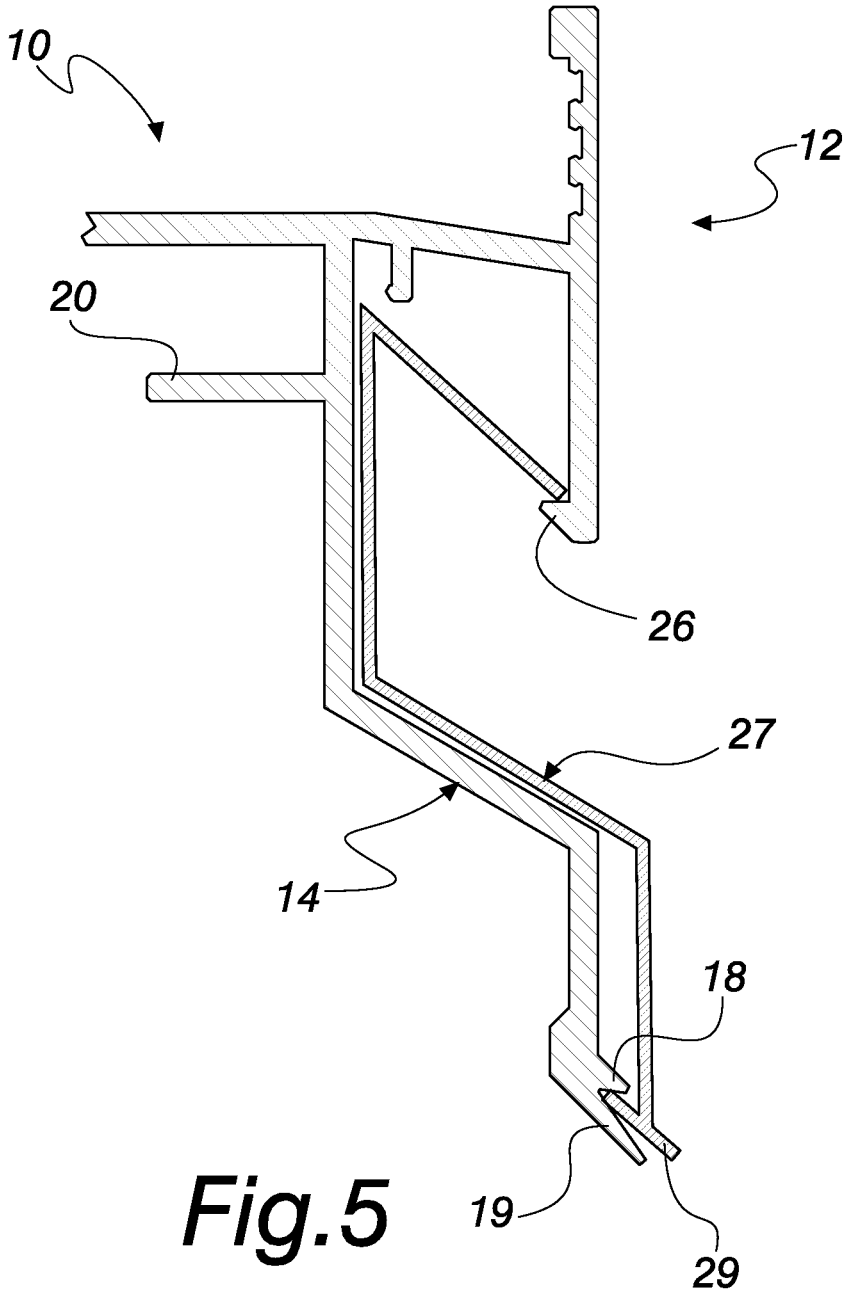
FIG. 5 is a cross-sectional view of a connector coupled to a profiled element according to the disclosure.

The connector 27 in its coupling with a profiled element 10 is shown in FIG. 5.

The disclosure also relates to the connector 27, to be associated by snap action with a pair of profiled elements 10, between the first and second protrusions 18, 19 and the tooth 26. In particular, for such purpose, the connector 27 is provided with an end element 29 which is inserted by snap action between the two protrusions 18 and 19.

As shown in FIG. 2, during installation of the profiled element 10 according to the disclosure, draining sponge tape 30 is conveniently used on the central connection 22 and adjacent to the inner side of the upper portion 24, and a layer of silicone sealant 31 is superimposed thereon. The draining sponge tape 30 prevents the sealant from obstructing the drainage openings 28.

Installation and operation of the profiled element, according to the disclosure, is evident from the foregoing description and, in particular, it is evident that the profiled element, by virtue of the spacer element and the double end projection of the drip lip, is capable of making water drip away from the walls, while favoring its vertical descent.

Furthermore, with the profiled element according to the disclosure, the stagnation of water that has seeped under the tiles is prevented, by favoring its drainage outward.

It should also be noted that by virtue of particular protrusions of the wing and of the upper portion of screen, the grip of adhesives is improved, thus ensuring an optimal hold.

In addition, it should be noted that the profiled element according to the disclosure facilitates the affixing of the connectors, which by virtue of snap action coupling can also be affixed after the installation of the profiled element.

Furthermore the connector, by virtue of the end part, contributes to keeping water away from the wall.

In practice it has been found that the disclosure fully achieves the intended aims and advantages by providing a profiled element for terraces that is capable of effectively preventing the return of water toward the wall and of favoring a better outflow of seeped water, and also of facilitating the affixing of connectors.

The disclosure, thus conceived, is susceptible of numerous modifications and variations. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A profiled element for terraces and balconies comprising a substantially flat wing for anchoring the profiled element to the floor, a front portion for protecting an outer edge of a floor paving and protruding outward with respect thereto, a drip lip which is constituted by a contoured element that extends downward from said flat wing, in a region to be arranged at an edge of a terrace, wherein said drip lip comprises, at a lower end, at least one first protrusion and at least one second protrusion, said at least one second protrusion being lower than the first protrusion, both first and second protrusions protruding outward with respect to said front portion, and a connector for connecting the profiled element to a similar profiled element being provided, said connector being associated, by snap action with a pair of profiled elements, between the first and second protrusions at one end and being anchored to a tooth at a front portion of said profiled elements.

2. The profiled element according to claim 1, wherein said second protrusion protrudes further outward than said first protrusion.

3. The profiled element according to claim 1, further comprising at least one spacer configured for spacing said front portion from the edge of the terrace, said at least one spacer includes a tab that protrudes from the rear of said drip lip and is configured to rest with its free end on said edge of the terrace.

4. The profiled element according to claim 1, wherein said front portion has a cross-section that is substantially T-shaped rotated by 90°, comprising a central connection to said flat wing and a screen, substantially on a vertical plane of arrangement, with an upper portion and a lower portion, and having a plurality of dovetail incisions defined on an inner side of said upper portion.

5. The profiled element according to claim 4, wherein said lower portion has, at a lower end, said tooth directed inward for anchoring said connector for connecting said profiled element to a similar profiled element.

6. The profiled element according to claim 4, wherein said central connection is inclined downward and is provided with a plurality of water drainage openings.

7. The profiled element according to claim 1, wherein said second protrusion has an inclination with respect to a horizontal plane comprised between 20° and 65°.

8. The profiled element according to claim 1, wherein said first and second protrusions include two cusps.

9. The profiled element according to claim 1, wherein said first and second protrusions include two tabs.

* * * * *